US007485056B2

(12) United States Patent
Sullivan et al.

(10) Patent No.: US 7,485,056 B2
(45) Date of Patent: Feb. 3, 2009

(54) FISH-HOLDING ARROWHEAD

(76) Inventors: Kevin Michael Sullivan, 633 Ramey Rd., Lakemont, GA (US) 30552; Dennis Edward Sullivan, 1474 Camp Creek Rd., Lakemont, GA (US) 30552

( * ) Notice: Subject to any disclaimer, the term of this patent is extended or adjusted under 35 U.S.C. 154(b) by 0 days.

(21) Appl. No.: 11/320,276

(22) Filed: Dec. 27, 2005

(65) Prior Publication Data

US 2006/0160642 A1 Jul. 20, 2006

Related U.S. Application Data

(63) Continuation-in-part of application No. 11/031,817, filed on Jan. 7, 2005, now Pat. No. 7,311,621.

(51) Int. Cl.
*F42B 6/08* (2006.01)

(52) U.S. Cl. ..... 473/583

(58) Field of Classification Search ..... 411/190, 411/204, 216, 321, 378, 427, 948, 303; 473/578, 473/582, 583, 584

See application file for complete search history.

(56) References Cited

U.S. PATENT DOCUMENTS

| | | | | | |
|---|---|---|---|---|---|
| 319,791 | A | * | 6/1885 | Conway | 411/325 |
| 578,717 | A | * | 3/1897 | Budlong | 411/322 |
| 859,063 | A | * | 7/1907 | Henson | 411/322 |
| 1,098,646 | A | * | 6/1914 | Stager | 411/216 |
| 1,358,795 | A | * | 11/1920 | Stillwell | 411/321 |
| 1,604,713 | A | | 10/1926 | Norlund | |
| 2,289,284 | A | | 7/1942 | Chandler | |
| 2,568,417 | A | | 9/1951 | Steinbacher | |
| 2,620,190 | A | | 12/1952 | Bean | |
| 2,820,634 | A | | 1/1958 | Vance | |
| 2,939,708 | A | | 6/1960 | Scheib | |
| 2,940,758 | A | * | 6/1960 | Richter | 473/584 |
| 2,993,697 | A | | 7/1961 | Urban | |
| 3,000,635 | A | | 9/1961 | Nieman | |
| 3,014,305 | A | | 12/1961 | Yurchich | |
| 3,022,077 | A | | 2/1962 | Doonan | |
| 3,036,395 | A | | 5/1962 | Nelson | |
| 3,036,396 | A | | 5/1962 | Swails | |
| 3,064,977 | A | | 11/1962 | Zwickey | |
| 3,138,383 | A | | 6/1964 | McKinzie | |
| 3,168,313 | A | | 2/1965 | Lint | |
| 3,241,836 | A | | 3/1966 | Zwickey | |
| 3,578,328 | A | | 5/1971 | Rickey | |
| 3,600,835 | A | | 8/1971 | Hendricks | |
| 3,738,657 | A | | 6/1973 | Cox | |
| 3,759,519 | A | | 9/1973 | Palma | |
| 4,099,720 | A | | 7/1978 | Zeren | |

(Continued)

*Primary Examiner*—John Ricci

(57) ABSTRACT

An arrowhead includes a threaded stud at the front end of the body for accepting an arrowhead tip. A longitudinal finger is disposed coaxial with the stud and projects forward therefrom. Engagement means are operatively associated with the tip for engaging the finger when an arrowhead tip is screwed onto the body to inhibit the tip from becoming unintentionally loosened with respect to the body.

In another aspect of the invention, a blade is pivotably mounted to an arrowhead body such that the blade is pivotably movable between first and second positions. The blade lies adjacent the body when in the first position. A slot is formed in the body adjacent the mounting position so as to receive a portion of the blade therewithin when the blade is in the first position, and a recess is formed around the slot to provide a means of escape for mud.

4 Claims, 6 Drawing Sheets

U.S. PATENT DOCUMENTS 4,166,619 A 9/1979 Bergmann et al.
4,452,460 A 6/1984 Adams
4,504,063 A 3/1985 LeBus
D279,813 S 7/1985 Palizzolo
4,565,377 A 1/1986 Troncoso, Jr. et al.
4,579,348 A 4/1986 Jones
4,600,343 A * 7/1986 Frerejacques ..... 411/303
4,615,529 A 10/1986 Vocal
4,729,320 A 3/1988 Whitten, III
4,807,382 A 2/1989 Albrecht
4,901,467 A * 2/1990 Stolpe ..... 43/6
4,932,671 A 6/1990 Anderson, Jr.
4,940,246 A 7/1990 Stagg
4,973,060 A 11/1990 Herzing
4,976,443 A 12/1990 DeLucia
4,988,112 A 1/1991 Anderson et al.
4,998,738 A 3/1991 Puckett
5,044,640 A 9/1991 DelMonte et al.
5,046,744 A 9/1991 Eddy
5,066,021 A 11/1991 DeLucia
5,078,407 A 1/1992 Carlston et al.
5,082,292 A 1/1992 Puckett et al.
5,083,798 A 1/1992 Massey
5,090,709 A 2/1992 Johnson
5,100,143 A 3/1992 Puckett
5,102,147 A 4/1992 Szeluga
5,112,063 A 5/1992 Puckett
5,172,916 A 12/1992 Puckett
5,178,398 A 1/1993 Eddy
5,178,500 A * 1/1993 Stencel ..... 411/2
5,286,035 A 2/1994 Ward
5,322,297 A 6/1994 Smith
5,394,859 A * 3/1995 Janeway ..... 124/87
5,458,341 A 10/1995 Forrest et al.
5,472,213 A 12/1995 Dudley
5,564,713 A 10/1996 Mizek et al.
5,803,844 A 9/1998 Anderson
5,803,845 A 9/1998 Anderson
5,820,498 A 10/1998 Maleski
5,857,930 A 1/1999 Troncoso
5,879,252 A 3/1999 Johnson
5,941,784 A 8/1999 Mizek
6,165,086 A 12/2000 Liechty, II
6,174,252 B1 1/2001 Mizek
6,217,467 B1 4/2001 Maleski
6,258,000 B1 7/2001 Liechty, II
6,270,435 B1 8/2001 Sodaro
6,398,676 B1 6/2002 Mizek
6,428,433 B1 * 8/2002 Liechty, II ..... 473/583
6,554,727 B1 4/2003 Armstrong et al.
6,669,586 B2 * 12/2003 Barrie et al. ..... 473/583
6,739,992 B2 * 5/2004 Kummerle ..... 473/582

* cited by examiner

FISH-HOLDING ARROWHEAD

CROSS-REFERENCE TO RELATED APPLICATIONS

This application is a continuation-in-part of my earlier filed U.S. patent application Ser. No. 11/031,817, filed Jan. 7, 2005 now U.S. Pat. No. 7,311,621.

TECHNICAL FIELD

The present invention relates generally to arrowheads, and relates more specifically to arrowheads with pivotably mounted blades or barbs which fold against the body for flight and deploy only after penetrating the target.

BACKGROUND OF THE INVENTION

Arrowheads are known in which blades or barbs are folded against the body while the arrow is in flight and then open on or after impact with the target. Having the blades folded against the body during flight increases the aerodynamic efficiency, penetration, and accuracy of the arrowhead. Arrowheads suitable for bow fishing have their blades folded rearward against the body during flight. The blades are pivotably mounted at their forward ends, and the blades remain folded against the body after contact with the target Once the arrow has penetrated into or through the body of the fish, if the struggling fish begins to work his way off the arrow, beveled surfaces at the rearward edges of the blades engage the fish and force the blades open, preventing the fish from sliding off the arrow. An example of such an arrowhead is shown in U.S. Pat. No. 6,793,596, which patent is hereby incorporated by reference.

SUMMARY OF THE INVENTION

Stated generally, the present invention comprises an arrowhead having an elongated body with front and rear ends and a means at the rear end of the body for coupling the body to an arrow shaft. A threaded stud is provided at the front end of the body for accepting an arrowhead tip. A longitudinal finger is disposed coaxial with the stud and projects forward therefrom. An arrowhead tip has a threaded bore configured to engage the threaded stud so as to mount the tip to the front end of the body. Engagement means are operatively associated with the tip for engaging the finger when the tip is screwed onto the body to inhibit the tip from becoming unintentionally loosened with respect to the body.

In another aspect of the invention, a first end of an elongated barb is pivotably mounted to a mounting location on an arrowhead body such that the barb is pivotably movable between first and second positions. The barb lies substantially parallel to the longitudinal axis of the arrowhead body with the second barb end adjacent the body when in the first position, and the second end of the barb extends away from the body when the barb is in the second position. A slot is formed in the body adjacent the mounting position so as to receive a portion of the barb therewithin when the barb is in the first position, and a recess is formed around the slot to provide a means of escape for mud.

Objects, features, and advantages of the present invention will become apparent upon reading the following specification, when taken in conjunction with the drawings and the appended claims.

DETAILED DESCRIPTION OF THE DISCLOSED EMBODIMENTS

Figure 1:
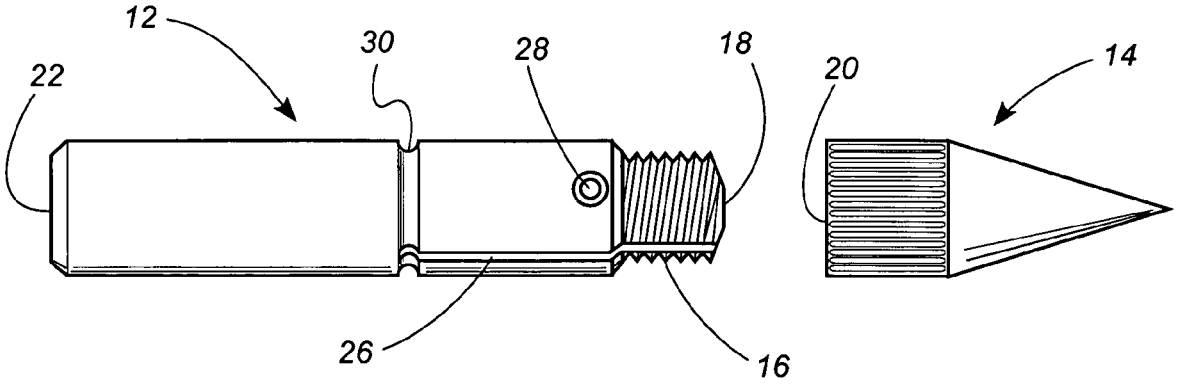
FIG. 1 is a side view of an arrowhead body and tip for use in an arrowhead according to the disclosed invention.

Referring now in more detail to the drawings, in which like numerals indicate like elements throughout the several views, FIG. 1 illustrates an arrowhead body 12 and an arrowhead tip 14. The arrowhead body 12 has a threaded boss 16 at its forward end 18, which is dimensioned to engage a corresponding threaded bore in the rearward end 20 of the tip 14. The arrowhead body 12 has an axial bore in its rearward end 22 which is configured to engage the tip of an arrow shaft (not shown).

Just rearward of the forward end 18 of the arrowhead body 12, a plurality of longitudinal slots 26 are formed around the periphery of the arrowhead body. In the disclosed embodiment there are three slots 26 spaced at 120° intervals to accommodate three blades, as will be shown below. However, it will be understood that a greater or lesser number of slots 26 may be provided, depending upon the number of blades desired.

Figure 2:
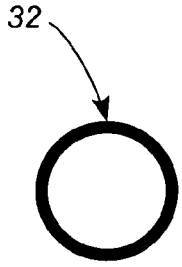
FIG. 2 is a front view of an O-ring for use in an arrowhead according to the disclosed invention.
Figure 3:
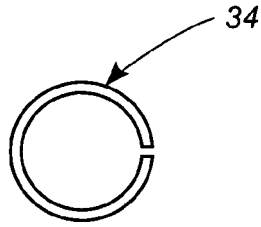
FIG. 3 is a front view of a split ring for use in an arrowhead as an alternative to the O-ring of FIG. 2.

Transverse to and in communication with each of the slots 26 is a bore 28. The bores 28 are transverse to and radially offset from the longitudinal axis of the arrowhead body 12. Each bore 28 of the disclosed embodiment is open at only one end, though a through hole is equally functional. At the rearward edge of the slots, a circumferential channel 30 is formed. The circumferential channel is adapted to receive either a rubber O-ring 32 (FIG. 2) or a split ring 34 (FIG. 3) of metal, plastic, or the like.

Figure 4:
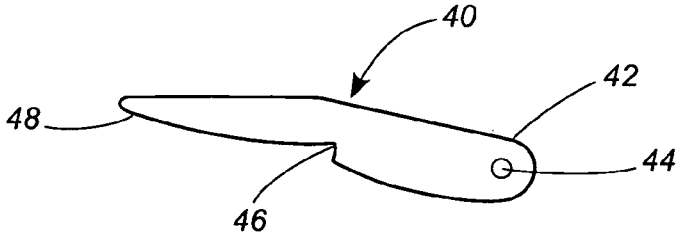
FIG. 4 is a side view of a blade for use in an arrowhead according to the disclosed invention.

FIG. 4 illustrates a blade 40 for use with the arrowhead body 12 of FIG. 1. Because the blade is adapted to prevent a fish from coming off an arrow shaft and is not adapted to penetrate or to cut the target, the blade has a blunt periphery devoid of sharp edges. The blade has a head portion 42 having a hole 44 therethrough. A notch 46 is formed in the lower portion of the blade 40. At the free end of the blade is a beveled edge 48.

Figure 5:
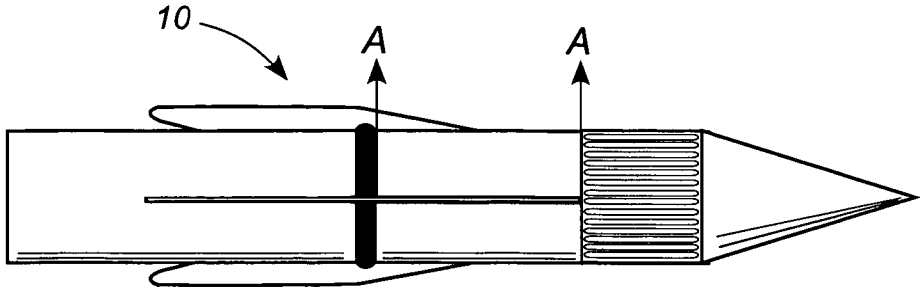
FIG. 5 is a side view of an assembled arrowhead comprising the arrowhead tip and body of FIG. 1 and the O-ring of FIG. 2.
Figure 6:
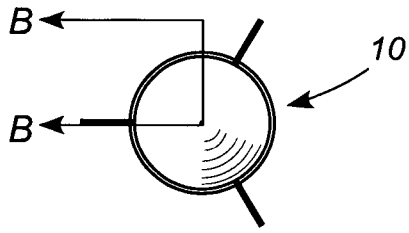
FIG. 6 is a front view of the arrowhead of FIG. 5.
Figure 7:
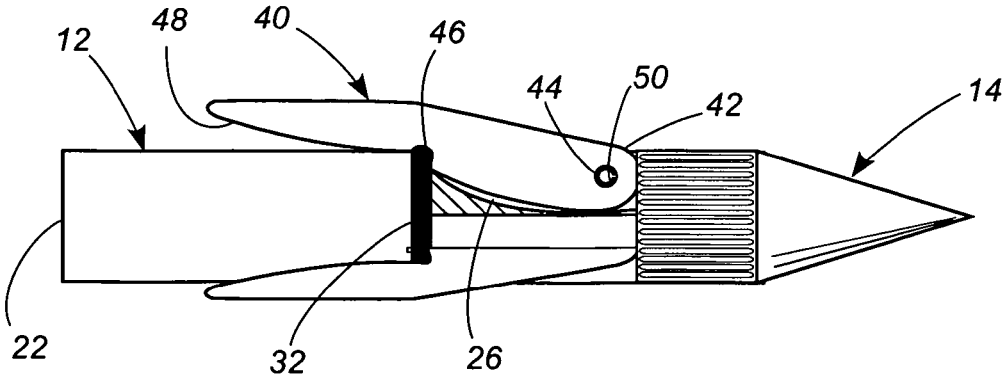
FIG. 7 is a side view of the arrowhead of FIG. 5 rotated 90° clockwise and cut away along lines A-A of FIG. 5 and B-B of FIG. 6.
Figure 8:
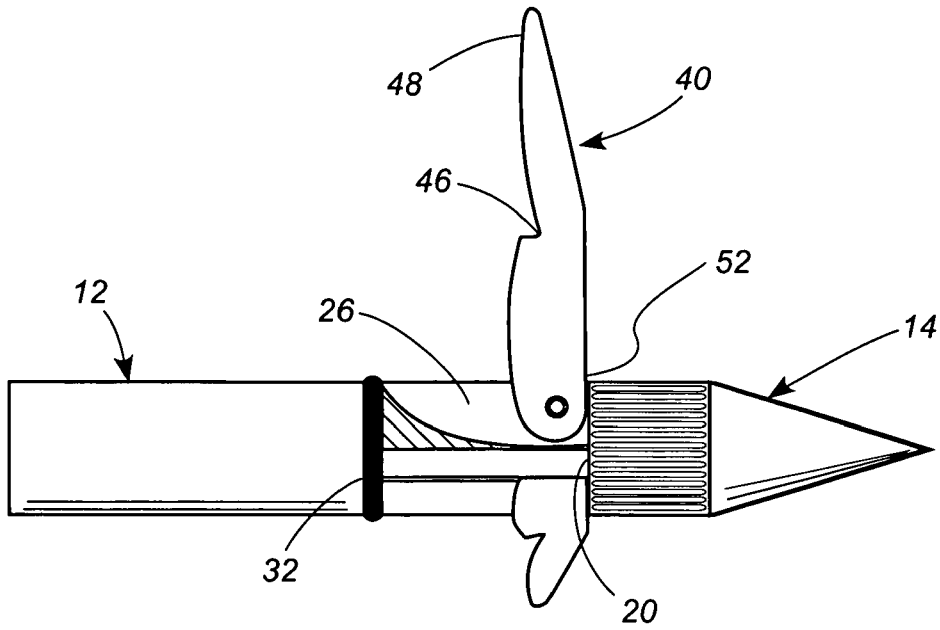
FIG. 8 is a side view of the arrowhead of FIG. 7 showing the blades extended in a deployed position.
Figure 9:
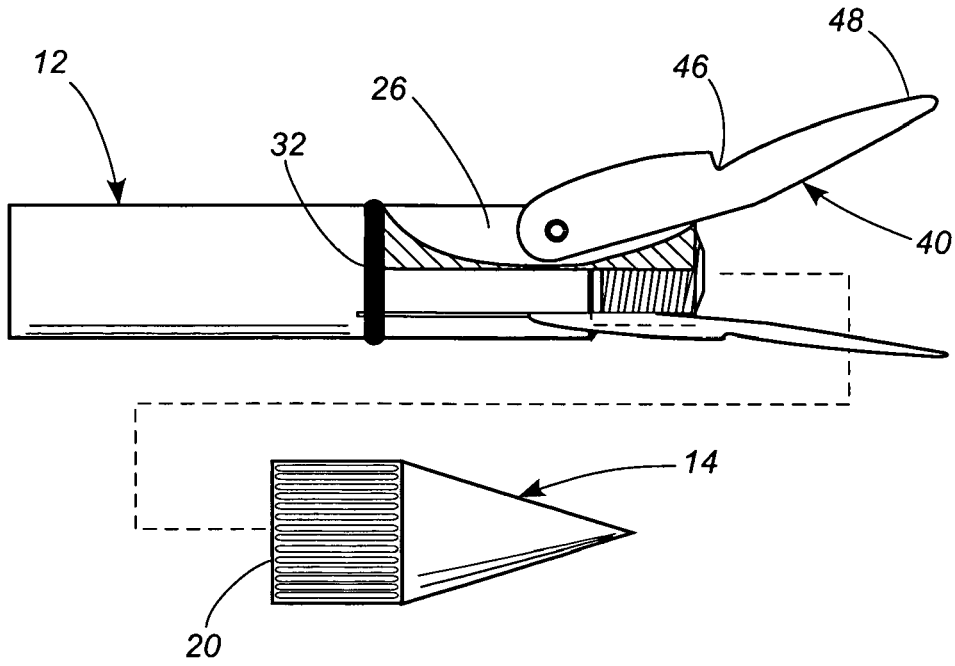
FIG. 9 is a side view of the arrowhead of FIG. 7 with the tip removed and the blades pivoted forward for removal of the arrow from a target.

FIGS. 5 and 6 are assembled views of an arrowhead 10 comprising the arrowhead body 12, tip 14, O-ring 32, and blade 40 and are included only to show section lines A-A and B-B, which indicate the cutaway portions of FIGS. 7-9.

Assembly of the arrowhead 10 will now be explained with reference to FIG. 7. The head portion 42 of a blade 40 is inserted into each longitudinal slot 26 of the arrowhead body 12. The blades are aligned such that the holes 44 in the blades are aligned with the bores 28 (FIG. 1) in the arrowhead body 12. A roll pin 50, also known as a spring pin or split pin, is inserted into the open end of each bore 28 and through the hole 44 in the head portion 42 of the corresponding blade 40. The roll pins 50 are retained snugly within the bores 28, and the blades 40 pivot freely on the roll pins.

Also shown in FIG. 7, an O-ring 32 has been advanced over the rearward end 22 of the arrowhead body 12 and seated into the circumferential channel 30 (FIG. 1). In the alternative, a split ring 34 can be spread and advanced over the rearward end 22 of the arrowhead body 12 and seated into the circumferential channel 30.

Operation of the arrowhead 10 will now be explained with reference to FIGS. 7-9. Referring first to FIG. 7, the notches 46 in the blades 40 engage the rubber O-ring 32 to retain the blades in their retracted position. The blades 40 remain in the retracted position, retained by the O-ring 32, during flight and during penetration of the target by the arrowhead.

Referring now to FIG. 8, when a struggling fish tries to back off the arrow, the distal surface of the fish will engage the beveled surfaces 48 of the blades 40, causing the notches to disengage from the O-ring 32 and causing the blades to pivot to the extended position shown in FIG. 8. The upper surfaces 52 of the blades 40 confront the rearward edge 20 of the tip 14 to prevent the blades from rotating any farther forward. The deployed blades prevent the arrowhead from being withdrawn from the fish.

When it is desired to remove the fish from the arrow, the tip 14 is unscrewed from the arrowhead body 12, as shown in FIG. 9. The blades 40 are thereafter free to pivot further forward to the position shown in FIG. 9, creating a sufficiently small profile that the arrowhead can be withdrawn through the fish.

When it is desired to reuse the arrowhead 10, the blades are pivoted back to their retracted position (FIG. 7), where the notches once again engage the rubber O-ring. The tip is then screwed back onto the arrowhead body 12, and the arrowhead is ready for reuse.

The O-ring serves as a retention means by flexing when the notch 46 of the blade 40 engages it. Thus it is not required that the O-ring be comprised of rubber. Rather, any suitable flexible material can be substituted.

In contrast to the O-ring, the split ring 34 comprises a relatively rigid material formed into a flexible structure, rather than a structure comprised of a flexible material. The retention means functions in the same manner however, namely, that the split ring 34 flexes when the notch of the arrow engages it to hold the blade in the retracted position.

Figure 10:
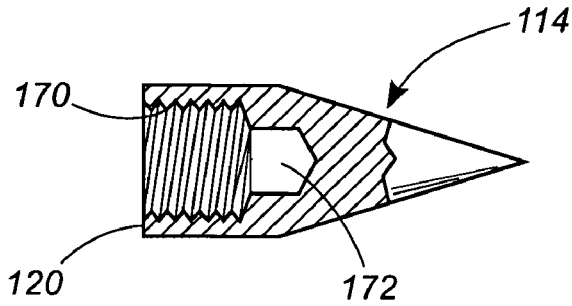
FIG. 10 is a partially cutaway view of an arrowhead tip of an alternate embodiment.

FIGS. 10-14 illustrate an alternate embodiment of an arrow head tip 114. Referring first to FIG. 10, the arrowhead tip 114 has a threaded bore 170 formed in its rearward face 120. A smooth counterbore 172 is formed coaxially with the threaded bore 170.

Figure 11:
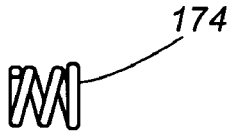
FIG. 11 is a coil spring for use with the arrowhead tip of FIG. 10.
Figure 12:
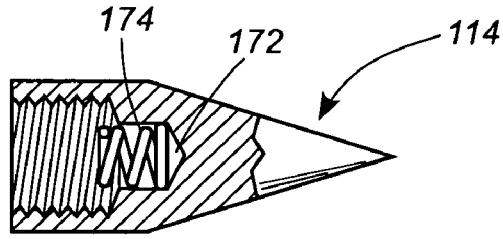
FIG. 12 is a partially cutaway view of the arrowhead tip of FIG. 10 with the coil spring of FIG. 11 positioned therewithin.

FIG. 11 illustrates a coil spring 174. In FIG. 12, the coil spring 174 is shown located within the smooth counterbore 172 of the arrowhead tip 114. When the arrowhead tip 114 with coil spring 174 is screwed onto the threaded boss 16 of an arrowhead body 12, the coil spring bears against the tip 18 of the arrowhead body. The spring 174 exerts a tension between the tip 114 and the arrowhead body 12 which prevents the tip from accidentally loosening.

Figure 13:
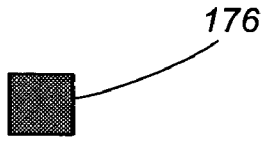
FIG. 13 is a cylindrical member of a deformable, resilient material such as rubber.
Figure 14:
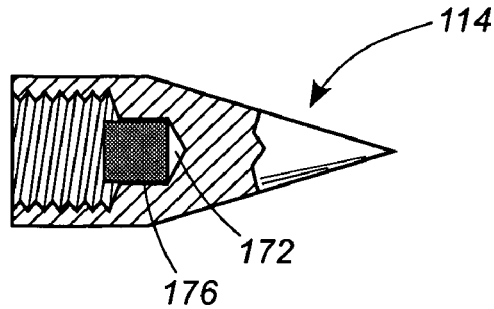
FIG. 14 is a partially cutaway view of the arrowhead tip of FIG. 10 with the cylindrical member of FIG. 13 positioned therewithin.
Figure 15:
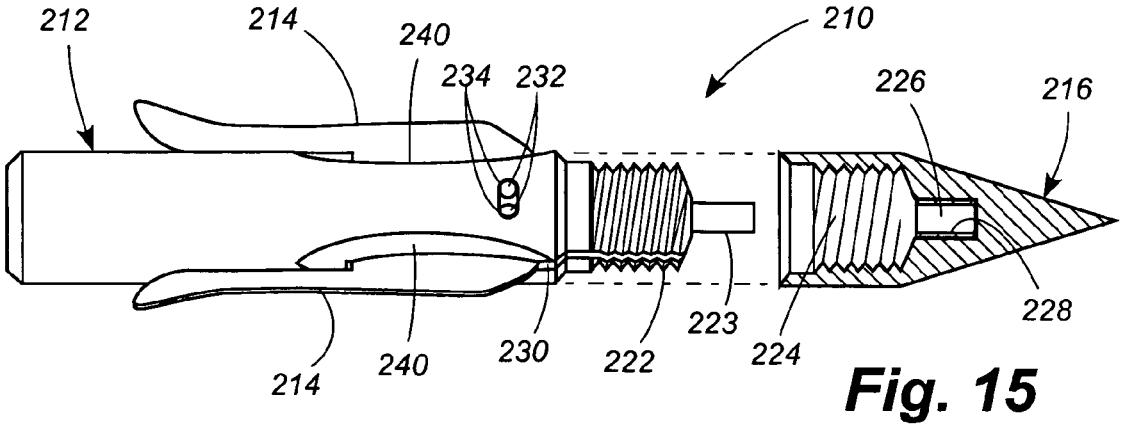
FIG. 15 is a partially exploded side view of a further embodiment of an arrowhead, with the tip cut away to reveal interior detail.

FIG. 13 illustrates a cylinder 176 of a deformable, resilient material such as rubber. FIG. 14 illustrates the cylinder 176 disposed within the smooth counterbore 172 of the arrowhead tip 114. When the arrowhead tip 114 with the cylinder 176 of deformable, resilient material is screwed onto the threaded boss 16 of an arrowhead body 12, the deformable, resilient material bears against the tip 18 of the arrowhead body. The spring effect of the deformable, resilient material exerts a tension between the tip 114 and the arrowhead body 12 which prevents the tip from accidentally loosening.

Figure 16:
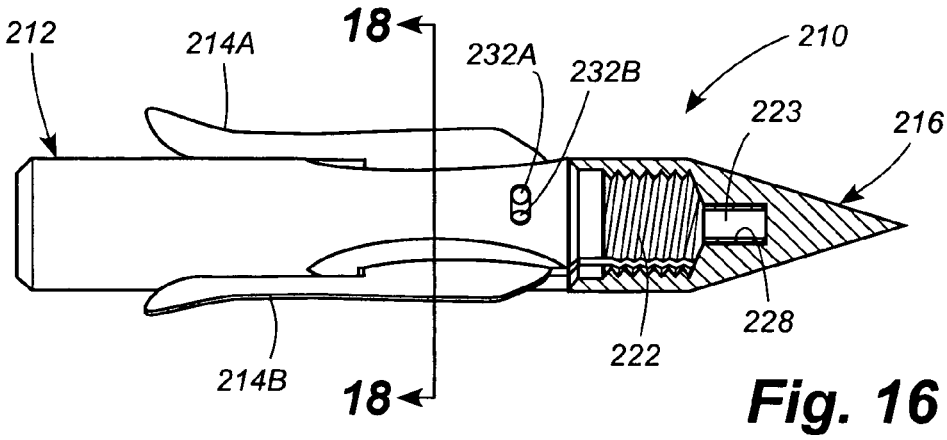
FIG. 16 is a side view of the arrowhead of FIG. 15.

Referring now to FIGS. 15-18, yet another embodiment of an arrowhead 210 is especially adapted for bow fishing. The arrowhead 210 comprises an arrowhead body 212, barbs 214, and a tip 216. The arrowhead body 212 has a threaded stud 222 at its forward end. A finger 223 projects forward from the stud 222. The tip 216 has a threaded bore 224 in its rearward end. A smooth counterbore 226 is formed coaxially with the threaded bore 224. A bushing 228 is disposed within the counterbore 226. As shown in FIG. 16, the tip 216 is attached to the arrowhead body 212 by screwing the tip onto the threaded stud 222 at the forward end of the arrowhead body. As the tip 216 is screwed onto the stud 222, the finger 223 enters the bushing 228 in the smooth counterbore 226. Friction between the finger 223 and the bushing 228 inhibits the tip 216 from becoming unintentionally loosened.

The bushing 228 within the counterbore 226 of the tip 216 is but one form of engagement member that can be provided to cooperatively engage the finger 223 on the arrowhead body 212 to inhibit the tip from becoming unintentionally loosened. Another form of engagement member might include protrusions on the walls of the counterbore 226 that are crushable as the finger 223 advances therewithin, creating an interference fit. Still another form of engagement member could include a high-friction surface formed directly on the wall of the counterbore. Other engagement means for creating an interference or friction fit between the finger 223 and the tip 216 will be apparent to those skilled in the art.

The arrowhead body 212 has three longitudinal slots 230 formed therein. The barbs 214 are freely pivotably mounted within the slots 230 by pins 232 inserted through openings 234 in the arrowhead body 212. Each pin 232 is mounted perpendicular to its associated barb. Referring to FIG. 16, the upper pin 232A is inserted through the upper barb 214A, and the lower pin 232B is inserted through the lower barb 214B.

Figure 17:
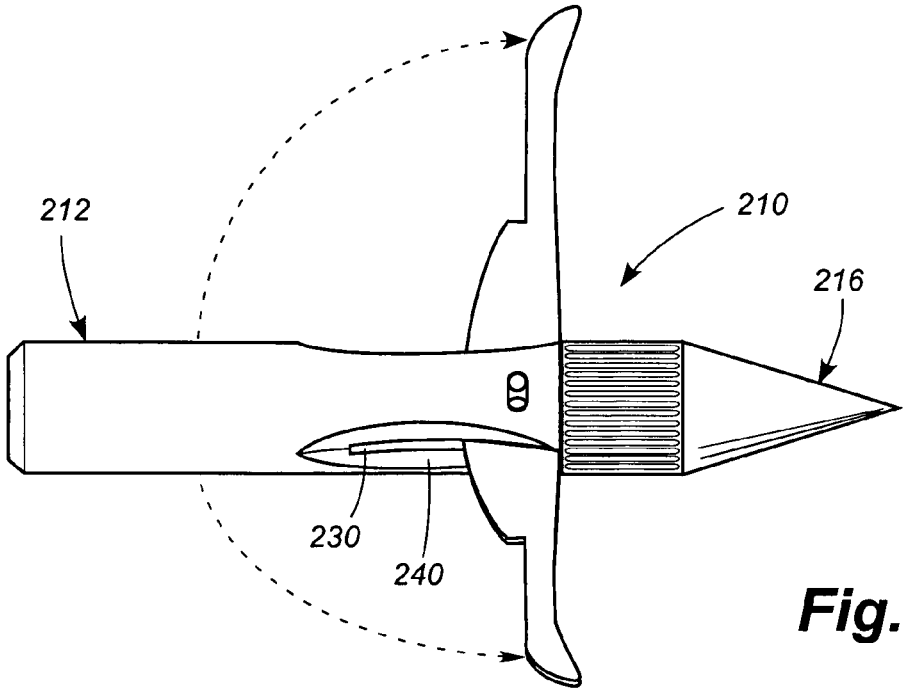
FIG. 17 is a side view of the arrowhead of FIG. 15 with barbs deployed.

Because the barbs are disposed at 120° intervals around the longitudinal axis of the body, the pins 232A, 232B are at 60° angles to one another. FIG. 17 shows the arrowhead 210 with barbs 214 extended.

Figure 18:
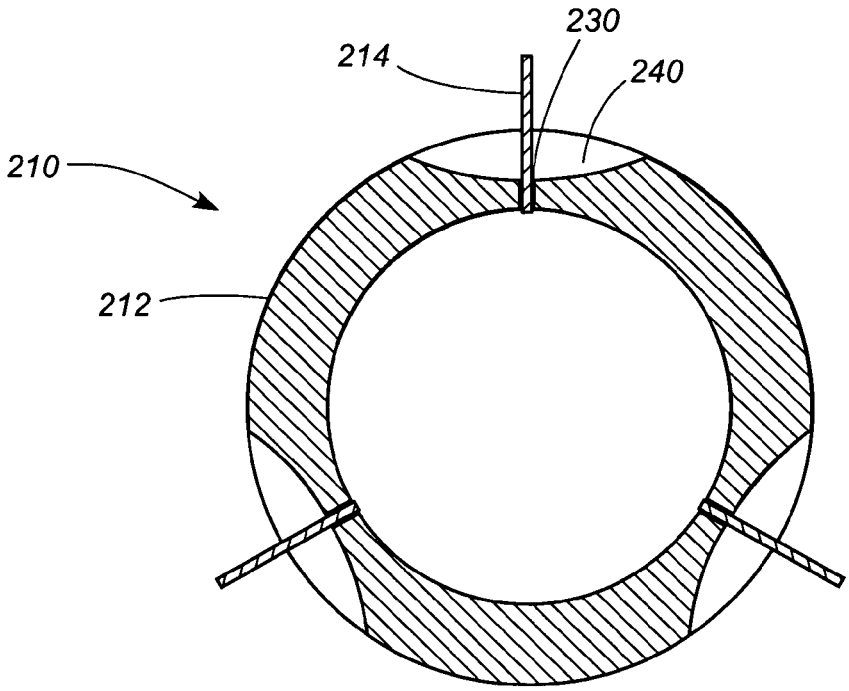
FIG. 18 is a cross-sectional view taken along line 18-18 of FIG. 16.

Surrounding the slots 230 are recesses 240. As can be seen in FIG. 18, the recesses 240 are scalloped or essentially V-shaped in cross-section, with the associated slot 230 at the base of the "V". When an arrow misses its target, the arrowhead 210 sometimes becomes encrusted with mud. When the archer attempts to pivot the barbs 214 to their closed positions, the encrusted mud tends to get jammed in the slots 230 and impede the barbs 214 from returning to their closed position. The recesses 240 provide a path for mud to be forced out laterally, allowing the barbs 214 to knife through the mud contained in the recesses and to displace the mud to either side of the barbs.

Figure 19:
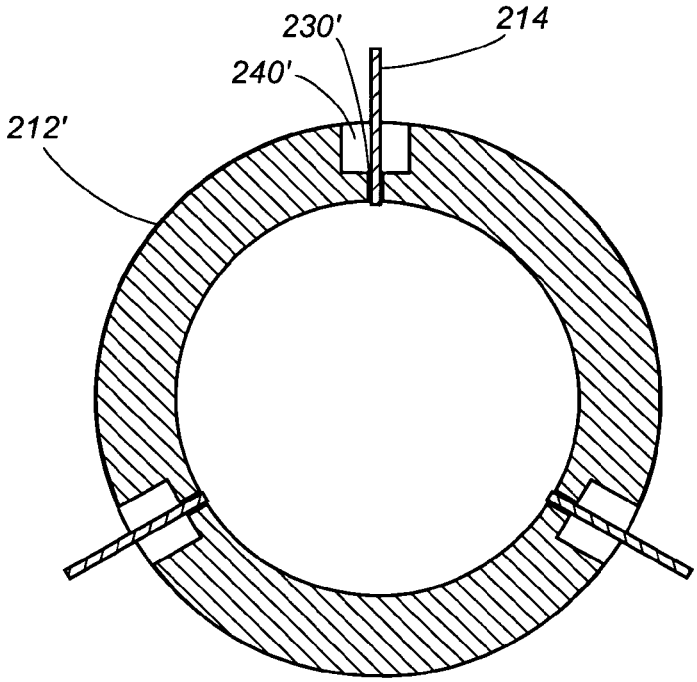
FIG. 19 is a cross-section similar to FIG. 18 of an alternate embodiment of a recess surrounding a slot in the arrowhead body.

While the recesses 240 are scalloped or substantially "V" shaped, other shapes would serve the same purpose, so long as there is added clearance around the barb slot to provide a path for mud to be displaced laterally. An example of an alternate design is shown in FIG. 19. Two straight slots (saw kerfs) 230', 240' are formed in the arrowhead body 212', one 230' slightly bigger than the barb 214 and another 240' coaxial with the first slot 230' and perhaps four times the thickness of the first. This alternate design would also allow the mud to escape the along the side of the barb 214.

While the foregoing embodiments have all been disclosed with respect to an arrowhead having barbs, blades are a suitable alternative to barbs. In the claims which follow, blades, barbs, and structural equivalents will be referred to collectively as grappling means.

Finally, it will be understood that the preferred embodiments have been disclosed by way of example, and that other modifications may occur to those skilled in the art without departing from the scope and spirit of the appended claims.

What is claimed is:

1. An arrowhead comprising:

an elongated body having front and rear ends;

means at said rear end of said body for coupling said body to an arrow shaft;

a threaded stud at said front end of said body for accepting an arrowhead tip;

a longitudinal finger coaxial with said stud and extending forward therefrom;

a tip having a threaded bore configured to engage said threaded stud so as to mount said tip to said front end of said body; and engagement means operatively associated with said tip for engaging said finger when said tip is screwed onto said body to inhibit said tip from becoming unintentionally loosened with respect to said body.

2. The arrowhead of claim 1, wherein said tip comprises a surface, and wherein said engagement means comprises said tip having an engagement surface disposed to engage said finger when said tip is screwed onto said body, said engagement surface having a coefficient of friction higher than a major portion of said surface of said tip.

3. The arrowhead of claim 1, further comprising:

a smooth bore defined within said tip coaxial with said threaded bore; and a bushing disposed within said smooth bore;

said smooth bore and said bushing being configured to receive said finger of said body snugly therewithin.

4. The arrowhead of claim 1, further comprising:

a smooth bore defined within said tip coaxial with said threaded bore; and crushable elements disposed within said bore and configured to be crushed by said finger as said tip is screwed onto said body so as to create an interference fit with said finger that inhibits loosening of said tip.

* * * * *